US005483873A

United States Patent [19]

Koivukunnas et al.

[11] Patent Number: 5,483,873

[45] Date of Patent: Jan. 16, 1996

[54] METHOD IN CALENDERING OF A PAPER WEB AND A CALENDAR THAT MAKES USE OF THE METHOD

[75] Inventors: Pekka Koivukunnas; Harri Kuosa; Jussi Tuomela, all of Järvenpää; Markku Ellilä; Mikko Tani, both of Helsinki, all of Finland

[73] Assignee: Valmet Paper Machinery Inc., Helsinki, Finland

[21] Appl. No.: 205,958

[22] Filed: Mar. 2, 1994

[30] Foreign Application Priority Data

Mar. 8, 1993 [FI] Finland ..... 931021

[51] Int. Cl.[6] ..... D21G 1/02

[52] U.S. Cl. ..... 100/38; 100/74; 100/93 RP; 100/153; 100/173; 162/206

[58] Field of Search ..... 100/38, 73–75, 100/92, 93 RP, 153, 173; 162/206, 207

[56] References Cited

U.S. PATENT DOCUMENTS

| | | | |
|---|---|---|---|
| 2,251,890 | 8/1941 | Montgomery | 162/206 |
| 3,254,593 | 6/1966 | Beachler | 100/38 |
| 3,938,261 | 2/1976 | Anderson | 162/207 |
| 4,207,143 | 6/1980 | Glomb et al. | 162/207 |
| 4,370,923 | 2/1983 | Schmidt | 100/47 |
| 4,653,395 | 3/1987 | Verkasalo | 100/93 RP |
| 4,786,526 | 11/1988 | Arai et al. | 427/249 |
| 4,786,529 | 11/1988 | Boissevain | 427/296 |
| 4,945,654 | 8/1990 | Mason | 34/23 |
| 5,020,469 | 6/1991 | Boissevain et al. | 118/67 |
| 5,033,373 | 7/1991 | Brendel et al. | 100/38 |
| 5,163,364 | 11/1992 | Bubik et al. | 100/38 |
| 5,245,920 | 9/1993 | Hess | 100/38 |
| 5,251,551 | 10/1993 | Abe et al. | 100/93 RP |

FOREIGN PATENT DOCUMENTS

| | | |
|---|---|---|
| 0529385 | 3/1993 | European Pat. Off. . |
| 63981 | 5/1983 | Finland . |
| 72552 | 2/1987 | Finland . |
| 882845 | 12/1988 | Finland . |
| 900432 | 7/1990 | Finland . |
| 912666 | 6/1991 | Finland . |
| 911521 | 9/1992 | Finland . |
| 4126233 | 9/1992 | Germany . |

OTHER PUBLICATIONS

Paperin Volmistus, OSA 2 (Papermaking, Part 2), 1201–1204, Turku 1983.

Jay H. Vreeland, Eric R. Ellis, and Kenneth B. Jewett, "Substrata Thermal Molding", 139–145, *Tappi Journal*, Nov. 1989.

Bruce F. Taylor and Suzanne B. St. James, "Supercalendar Control Improves Quality and Productivity at Provincial Papers," 95–103, *Tappi Journal*, Jan. 1991.

*Primary Examiner*—Stephen F. Gerrity
*Attorney, Agent, or Firm*—Smith-Hill and Bedell

[57] ABSTRACT

A paper web is passed through a calendering nip that is formed between a roll which has been provided with a soft face and a heatable hard roll. The heatable roll is heated so as to plasticize the surface layer of the paper web that is placed at the side of the heatable roll, preferably so that the temperature of the surface layer in the calendering nip exceeds the glass-transition temperatures of the polymers contained in the paper. Before entering into the calendering nip, the paper web is moistened, so as to lower the glass-transition temperatures of the polymers contained in the paper, and pre-heated. The pre-heating of the paper web is carried out by bringing the paper web into contact with the heatable roll before the web enters the calendering nip and by, before the calendering nip, feeding steam or water onto the face of the paper web that is placed at the side of the heatable roll so as to improve the transfer of heat from the hot roll to the paper web.

16 Claims, 2 Drawing Sheets

METHOD IN CALENDERING OF A PAPER WEB AND A CALENDAR THAT MAKES USE OF THE METHOD

BACKGROUND OF THE INVENTION

The invention concerns a method in calendering of a paper web, wherein the paper web is passed through a calendering nip, which calendering nip is formed between a roll which has been provided with a soft face by means of a coating or in an equivalent way and a heatable hard roll, in which method the heatable roll is heated so as to plasticize the surface layer of the paper web that is placed at the side of the heatable roll, preferably so that the temperature of the surface layer in the calendering nip exceeds the glass-transition temperatures of the polymers contained in the paper, and in which method, before entering into the calendering nip, the paper web is moistened, so as to lower the glass-transition temperatures of the polymers contained in the paper, and pre-heated.

The invention also concerns a calender that makes use of the method, which calender comprises a calendering nip, which is formed between a roll that has been provided with a soft face by means of a coating or in an equivalent way and a heatable hard roll and through which calendering nip the paper web is arranged to run, the heatable roll being arranged to be heated so as to plasticize the surface layer of the paper web that is placed at the side of the heatable roll, preferably so that the temperature in the surface layer in the calendering nip exceeds the glass-transition temperatures of the polymers contained in the paper, and the calender comprising means for moistening and pre-heating of the paper web immediately before the calendering nip.

By means of calendering of paper, attempts are made to improve the quality values of paper that have already been achieved or, with a standard quality level, to achieve a higher running speed or a better bulk of the paper. The plasticity (readiness of moulding) of paper can be increased by raising the temperature or increasing the moisture content in the paper. A considerable change takes place in the plasticity of paper when the temperature of the polymers contained in the paper rises up to or beyond the so-called glass-transition temperature. Then, the paper can be moulded more readily than below the glass-transition temperature. An increased moisture content in paper lowers the glass-transition temperature. Most commonly, the paper web is heated in a calender nip by means of a heatable roll, a so-called thermo roll, and, in addition to this, possibly by means of steam treatment before the nip. The steam treatment also increases the moisture content in the paper, and thereby lowers the glass-transition temperature. However, there is the problem that the paper does not have time to be heated sufficiently in the nip and that the steam escapes into the environment before the calender.

Besides to the prior art described above, reference is also made, among other things, to the DE Patent 4,126,233, which concerns a method and a device in glazing of a paper web. In said method, the paper web is first heated by means of heat radiators so that, on the faces of the paper, a plasticizing temperature is reached, after which the paper web is passed through a pair of rolls that form a nip, wherein the paper web is pressed and cooled in the nip. Said method and device involve a number of drawbacks, so that their objectives are unlikely to be achieved. Firstly, this comes from the fact that the web is heated considerably before the nip, in which case the web has time to be cooled before it reaches the nip. This affects the paper web so that, immediately after heating, the surface temperatures of the paper indeed become very high, but, before the nip is reached, these surface temperatures are lowered and, correspondingly, the temperature in the interior of the paper web becomes higher. One of the most important objectives of the solution of the DE patent publication was expressly to make the surface temperatures of the paper rise to the plasticizing temperature and to prevent the lowering of said temperatures before the nip. In said DE publication, the cooling proper was supposed to be carried out rapidly expressly in the nip. These objectives are not achieved in the solution of said DE publication, as was ascertained above.

With respect to the prior art, reference is made further to the U.S. Pat. No. 5,033,373. In said paper, a calender of two nips is described for two-sided glazing of a paper web. In the following, just one of the calender nips will be examined, because it is, in principle, identical with the other nip. Thus, the nip is formed conventionally out of a heatable hard roll and a soft-faced roll which is in nip contact with the hard roll. Before entering into the nip, the paper web is cooled by means of a cooling device, and thereafter, after the web has been cooled, the side of the web that will reach contact with the hot nip roll is heated by means of a heating device, preferably a heat radiator or hot-air blowing. The purpose of this heating is to make the paper face as hot as possible even before it enters into the nip.

After the heating device, the web is passed over a guide roll, which guides the web into the nip. Said guide roll is placed in such a position in relation to the nip that the web reaches contact with the hot roll even before it enters into the nip. Further, the position of the guide roll is adjustable so that, by means of regulation of the position of the guide roll, it is possible to regulate the distance of contact between the web and the hot roll before the nip. As was already stated above, the object of the solution in accordance with said US patent is to make the web as hot as possible even before the nip.

This method and device, however, firstly involve the drawback that the heating of the web by means of a separate heating device is carried out considerably before the nip, in which case the web has time to be cooled before it enters into the nip or reaches contact with the hot roll. Also, this method and device involve a second drawback, i.e. that the heating before the nip is carried out by means of a heat radiator or hot-air blowing, as a result of which heating the web is dried before it enters into the nip. On the other hand, the drying of the web raises the glass-transition temperature of the paper. This again has the further consequence that the temperature of the hot roll in the calendering nip must be made very high in order that the glass-transition temperature could be produced in the paper web in the nip. Owing to the very high temperature, the constructions necessarily become complicated and expensive.

In the U.S. Pat. No. 5,163,364, a method is described for calendering of a paper or board web, wherein the calendering nip is a so-called extended nip which is formed between a roll and a belt that runs along a glide shoe. In the method of said paper, the web is passed into the nip when wet, but a pre-moistening proper of the web is, however, not described in the paper. Nor does the paper give any description of a pre-heating of the web before it enters into the calendering nip.

In the publications FI Patent 63,981 (equivalent to U.S. Pat. No. 4,370,923), FI Patent 72,552, and FI Pat. Appl. 900432 (equivalent to U.S. Pat. No. 5,020,469) different modes of calendering are described and discussed, wherein the paper web is moistened right before the web enters into the calendering nip. In the solutions in accordance with these papers, the moistening of the web is carried out by means of steam, but pre-heating of the paper web before the web enters into the calendering nip is not suggested.

In the FI Pat. Appl. 912666 (equivalent to U.S. Pat. No. 5,245,920), heating of a heatable roll in a calender to a temperature higher than the glass-transition temperature of the material to be calendered is described. Further, in said paper, pre-heating and pre-moistening of the paper web are described before the web enters into the nip. On the contrary, the mode of pre-heating of the web described in said paper differs substantially from the solution of the present invention, being more difficult to carry out than in the present invention.

In the publications of FI Pat. Appl. 914933 (equivalent to U.S. Pat. No. 4,945,654) and FI Pat. Appl. 882845 (equivalent to U.S. Pat. No. 4,786,529), methods are described wherein the web is moistened with steam before the calendering nip, but pre-heating of the web is not suggested in these papers.

SUMMARY OF THE INVENTION

The object of the present invention is to provide an improved method in calendering of a paper web as well as a calender that makes use of this method and by whose means the drawbacks involved in the prior-art solutions are avoided.

In view of achieving the objectives of the invention, the method in accordance with the invention is mainly characterized in that the pre-heating of the paper web is carried out by bringing the paper web into contact with the heatable roll before the web enters into the calendering nip and by, before the calendering nip, feeding steam or water onto the face of the paper web that is placed at the side of the heatable roll so as to improve the transfer of heat from the hot roll to the paper web.

On the other hand, the calender in accordance with the invention is mainly characterized in that the means for moistening of the paper web have been arranged to feed steam or water onto the face of the paper web that is placed at the side of the heatable roll so as to improve the transfer of heat from the hot roll to the paper web, and the means for pre-heating of the paper web consist of said means for moistening of the paper web as well as of means for guiding the paper web into contact with the heatable roll before the web enters into the calendering nip.

In comparison with the prior art, by means of the present invention, a number of advantages are obtained, of which, e.g., the following should be stated in this connection. In the method of the invention, the paper face is heated by bringing it into contact with the hot roll in the calender before the nip, as is the case also in the solution of the U.S. Pat. No. 5,033,373. However, in the present invention, in addition to this, steam is fed between the paper web and the hot roll, which has the consequence that the steam cannot escape into the environment, in which case the moisture and the amount of heat contained in the steam can be utilized completely and that the steam improves the transfer of heat from the hot roll to the paper web. Thus, in addition to the fact that the web can be passed into the nip hot, it has also been moistened before it enters into the nip, whereby its glass-transition temperature has been lowered. Thus, the improvement is also substantial in comparison with the solution of the U.S. Pat. No. 5,033,373. The further advantages and characteristic features of the invention come out from the following detailed description of the invention. In the following, the invention will be described by way of example with reference to the figures in the accompanying drawing.

DETAILED DESCRIPTION

Figure 1:
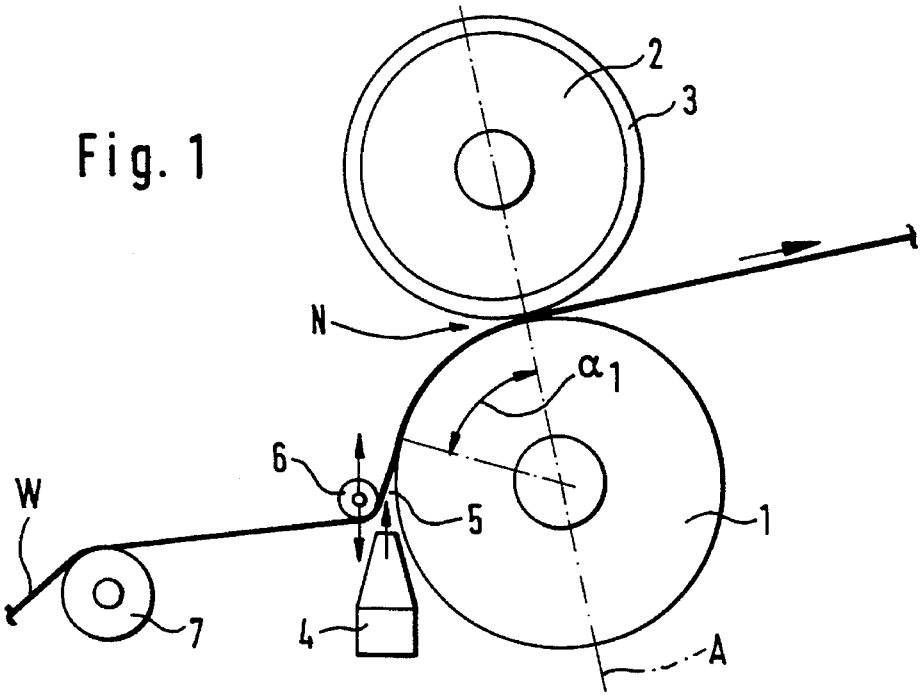
FIG. 1 is a fully schematic side view of an embodiment of the calender that makes use of the method in accordance with the invention.

In the exemplifying embodiment of FIG. 1, the calendering nip N is formed between the nip rolls 1,2, of which rolls the first roll 1 is a hard-faced roll that is heated in the normal way, and the second roll 2 is a soft-faced roll which is provided with a suitable coating 3. The nip plane that runs through the centre axes of said rolls 1,2 is, in FIG. 1, denoted with the reference A. The paper web W is passed into the nip as guided by the guide roll 7 and by the alignment roll 6. The alignment roll 6 is arranged in such a way in relation to the hot roll 1 of the calender that the alignment roll 6 does not guide the web W directly into the nip N, but that, before entering into the nip N, the web W is placed in contact with the face of the hot roll 1. In accordance with the exemplifying embodiment shown in FIG. 1, the position of the alignment roll 6 may additionally be adjustable so that, by means of regulation of the position of the alignment roll 6, the distance of contact between the web W and the face of the hot roll 1, i.e. the contact angle $\alpha_1$, can be adjusted.

Moreover, the alignment roll 6 has been arranged at the vicinity of the hot roll 1 so that a little gap remains between the alignment roll 6 and the hot roll 1, whereby, when running over the alignment roll 6, the paper web forms a gap 5 with the hot roll 1 before it enters into contact with the face of the hot roll 1. At the vicinity of said gap 5, a steam box 4 or equivalent moistening means are fitted, which feed steam or water into said gap 5, between the paper web W and the face of the hot roll 1 so as to moisten the paper web W and to improve the transfer of heat from the hot roll 1 to the paper web. The steam or water is fed preferably directly onto the paper web W before the web W reaches contact with the face of the roll 1. Thus, when steam is used as the moistening medium, the steam cannot escape into the environment, but the moisture and the amount of heat contained in the steam can be utilized completely. Further, the steam or the moistening water, respectively, operates as a heat conductor between the hot roll 1 and the paper web W, in which case, even though the alignment roll 6 and the hot roll 1 do not form a closed nip with one another, air cannot enter between the paper web W and the roll 1 to such an extent that it could interfere with the operation of the device. The steam or the equivalent moistening water may also be fed onto the paper web W considerably earlier, even before the alignment roll 6.

Figure 2:
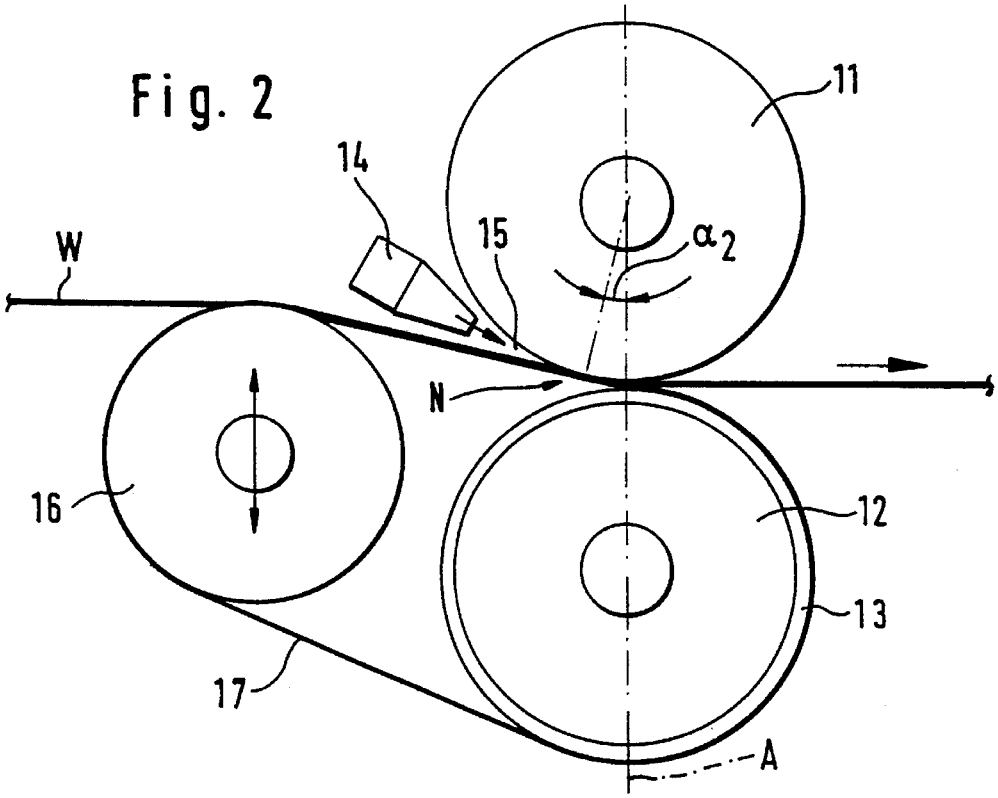
FIG. 2 is an illustration corresponding to FIG. 1 of a second embodiment of the calender that makes use of the method in accordance with the invention.

FIG. 2 shows a second, alternative embodiment of a calender that makes use of the method of the invention. In the embodiment of FIG. 2, the calendering nip N is formed between the rolls 11,12, of which rolls the first roll 11 is a heatable, hard-faced roll, and the second roll 12 is a so-called soft-faced roll, which is provided with a coating 13. The embodiment of FIG. 2 differs from that shown in FIG. 1 in the respect that, in the solution of FIG. 2, in the running direction of the paper web W, before the nip N, an alignment roll 16 is fitted and that a band 17 that has been formed as an endless loop is passed around said alignment roll 16 and around the soft-faced roll 12, which band, thus, runs through the nip N. The position of the alignment roll 16 in relation to the nip N is such that, when the web W arrives on the alignment roll 16, it enters into contact with the band 17 and is transferred on support of the band 17 into the nip N. Further, the position of the alignment roll 16 in relation to the nip N is such that the band 17 or, more accurately, the paper web W that runs on the band reaches contact with the heatable roll 11 before the nip N. In FIG. 2, the nip plane is denoted with the reference A.

The position of the alignment roll 16 can be adjusted so that, by means of this regulation of the position, it is possible to adjust the contact angle $\alpha_2$ between the paper web W and the heatable roll 11, i.e. the distance over which the paper web W is in contact with the heatable roll 11 before the nip N. In addition to the fact that, in the embodiment of FIG. 2, it is possible to adjust the contact angle $\alpha_2$, i.e. the "pre-heating angle", simply by changing the position of the alignment roll 16, in this embodiment, it is, by means of simple operations, also possible to regulate the pressure with which the paper web W is pressed against the heatable roll 11 before the nip N. This so-called "pre-heating pressure" is adjusted simply by adjusting the tension of the band 17.

As is the case in the embodiment of FIG. 1, so also in the solution shown in FIG. 2, steam or water is fed between the paper web W and the heatable roll 11 into the gap 15 between the web W and the heatable roll 11. Also in this embodiment, the steam or water is preferably fed directly onto the paper web W. For this purpose, at the inlet side of the web W, in relation to the nip N, a steam box 14 or equivalent moistening means are provided, which, differing from what is shown in FIG. 2, may be arranged to feed steam or water onto the paper web W considerably before the gap 15, into the area between the alignment roll 16 and the nip N. The band 17 may be a thin metal band, preferably a steel band, or, for example, a fibre-reinforced polymer band.

Figure 3:
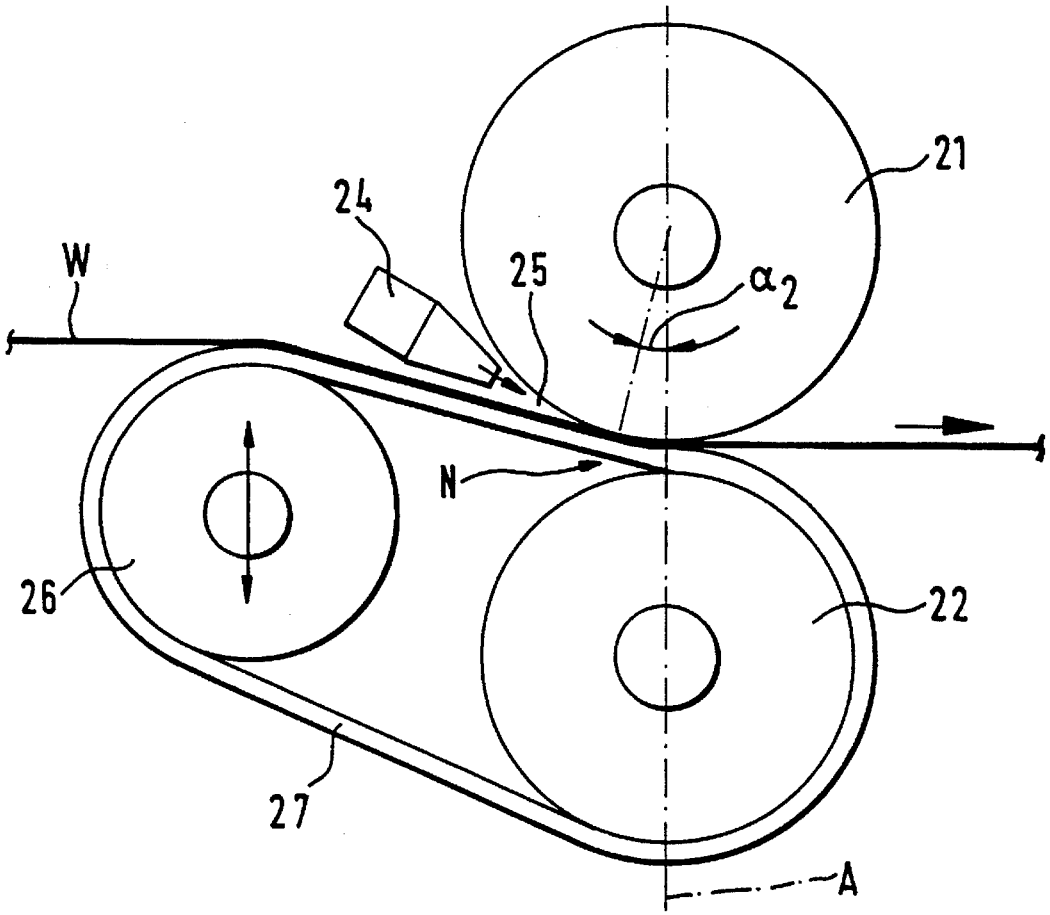
FIG. 3 is a corresponding illustration of a third preferred embodiment of the invention.

The embodiment shown in FIG. 3 is externally very far similar to the solution shown in FIG. 2. Regarding the reference denotations used in FIG. 3, it should be stated that the calendering nip is denoted with the reference N, as is the case in the former embodiments. In the embodiment of FIG. 3, the nip N is formed between the rolls 21,22, of which rolls the first roll 21 is, similarly to FIG. 2, a heatable, hard-faced roll. In this embodiment, as is also the case in FIG. 2, in the running direction of the paper web W, before the calendering nip N, an alignment roll 26 is fitted so that a band, belt or equivalent 27 that has been formed as an endless loop is passed around said alignment roll 26 and around the roll 22 that forms the calendering nip N with said heatable hard roll 21, said band or belt 27 passing through the calendering nip N. In the embodiment of FIG. 3, the alignment roll 26 has been arranged, in a way corresponding to FIG. 2, so that the position of the alignment roll 26 in relation to the nip N is such that, when the paper web W arrives at the alignment roll 26, the paper web reaches contact with the band or belt 27 and is transferred in a corresponding way, carried by the band or belt 27, into the calendering nip N. Further, the position of the alignment roll 26 in relation to the calendering nip is such that the band, belt or equivalent 27 or, more accurately, the paper web W that runs on same reaches contact with the heatable roll 21 before the nip N. Also in the solution of FIG. 3, the nip plane is denoted with the reference A.

The position of the alignment roll 26 can be adjusted so that, by means of said regulation of the position, it is possible to adjust the contact angle $\alpha_2$ between the paper web W and the heatable roll 21, i.e. the distance over which the paper web W is in contact with the heatable roll 21 before the calendering nip N. In addition to the fact that the contact angle $\alpha_2$, i.e. the "pre-heating angle", i.e. the contact distance of the paper web W with the heatable roll 21, can be regulated by changing the position of the alignment roll 26, in the way corresponding to FIG. 2, in the embodiment of FIG. 3, by means of simple operations, it is also possible to adjust the pressure with which the paper web W is pressed against the heatable roll 21 before the calendering nip N. This so-called pre-heating pressure is, thus, regulated by adjusting the tension of the band or belt 27, so that the position of the alignment roll 26 is changed.

In the embodiment of FIG. 3, as is also the case in the former embodiments, the heatable roll 21 is heated so as to plasticize the surface layer of the paper web W that is placed at the side of said roll 21 preferably so that the temperature of said surface layer in the calendering nip N exceeds the glass-transition temperatures of the polymers contained in the paper. Further, the paper web W is moistened before the paper web W enters into the calendering nip so as to lower the glass-transition temperatures of the polymers contained in the paper. For this purpose, steam or water is fed onto the paper web W by means of the moistening means 24 shown in FIG. 3, such as a steam box or equivalent. In the embodiment of FIG. 3, the moistening means 24 are arranged to feed the moistening medium into the gap 25 between the paper web W and the heatable roll 21. The moistening medium may, however, also be fed onto the paper web W before the gap 25. Besides the fact that, owing to the moistening, the glass-transition temperatures of the polymers contained in the paper can be lowered, by means of the moistening the transfer of heat from the hot roll 21 to the paper web W is improved.

The solution shown in FIG. 3 differs most essentially from that shown in FIG. 2 in the respect that both of the rolls 21, 22 that form the calendering nip N are hard-faced rolls. This means that the back-up roll 22 which forms the nip N with the heatable hard roll 21 is a hard roll. In the embodiment of FIG. 3, adequate softness is provided in the nip N by means of the band 27, belt or equivalent. In the exemplifying embodiment of FIG. 3, the material of the band 27 is preferably a fibre-reinforced polymer band, in which the polymer material is similar to that used, e.g., as a coating 3 on the roll 2 as shown in FIG. 1.

Above, the invention has been described by way of example with reference to the figures in the accompanying drawing. The invention is, however, not confined to the exemplifying embodiments shown in the figures alone, but different embodiments of the invention may show variation within the scope of the inventive idea defined in the accompanying patent claims.

We claim:

1. A method of calendering a paper web, comprising:

providing apparatus that comprises a first roll and a second roll in nip forming relationship, a paper alignment roll spaced from the first and second rolls, and an endless band trained around the second roll and the paper alignment roll and extending through the nip formed by the first and second rolls, wherein the first roll is a hard roll and the endless band presents a soft face to the first roll, rotating the first and second rolls in first and second opposite senses and rotating the paper alignment roll in the second sense, whereby the endless band is fed around the second roll and the paper alignment roll and passes through the nip, the first and second senses being such that the endless band passes from the paper alignment roll to the nip, positioning the paper alignment roll such that the endless band wraps partially around the first roll upstream of the nip, passing the web around the paper alignment roll and between the first roll and the endless band, whereby the web passes along the endless band into the nip with a first surface layer of the web toward the first roll and contacts the first roll before entering the nip, heating the first roll to an extent such that the first surface layer of the paper web is plasticized, and feeding steam or water onto the first surface layer of the paper web upstream of contact with the first roll.

2. A method according to claim 1, comprising heating the first roll to an extent such that temperature of the first surface layer of the web in the nip exceeds glass-transition temperatures of polymers contained in the paper.

3. A method according to claim 1, comprising adjusting the position of the paper alignment roll to vary the extent to which the endless band wraps around the first roll upstream of the nip.

4. A method according to claim 1, wherein the second roll is a hard roll.

5. A method according to claim 1, wherein the endless band has a soft face.

6. A method according to claim 1, wherein the endless band is made of metal and the second roll has a soft face.

7. A method according to claim 1, comprising adjusting pressure of the paper web against the first roll upstream of the nip.

8. A method according to claim 7, comprising adjusting the pressure of the paper web against the first roll by adjusting tension of the endless band.

9. A method according to claim 1, comprising adjusting extent over which the web wraps around the first roll before entering the nip by adjusting the paper alignment roll and the endless band.

10. A calender for calendering a paper web, comprising:

a first roll, said first roll being a hard roll, a second roll in nip forming relationship with the first roll, a paper alignment roll spaced from the first and second rolls, an endless band trained around the second roll and the paper alignment roll and extending through the nip formed by the first and second rolls, wherein the endless band presents a soft face to the first roll, whereby when the first and second rolls are rotated in first and second opposite senses and the paper alignment roll is rotated in the second sense, the endless band is fed around the second roll and the paper alignment roll and passes through the nip, the first and second senses being such that the endless band passes from the paper alignment roll to the nip, wherein the paper alignment roll is positioned such that the endless band wraps partially around the first roll upstream of the nip, whereby when the paper web is passed around the paper alignment roll and between the first roll and the endless band, the web passes along the endless band into the nip with a first surface layer of the web toward the first roll and contacts the first roll before entering the nip, a heating means for heating the first roll to an extent such that the first surface layer of the paper web is plasticized, and means for feeding steam or water onto the first surface layer of the paper web upstream of contact with the first roll.

11. A calender according to claim 10, wherein the heating means comprises a means for heating the first surface layer of the web to an extent such that temperature of the first surface layer in the nip exceeds glass-transition temperatures of polymers contained in the paper.

12. A calender according to claim 10, wherein the endless band is made of a resilient material.

13. A calender according to claim 10, wherein the endless band is made of a fiber-reinforced polymer material.

14. A calender according to claim 10, wherein the band is made of metal.

15. A calender according to claim 14, wherein the band is made of steel.

16. A calender according to claim 10, wherein the second roll is a soft faced roll.

* * * * *